United States Patent [19]

Lenk

[11] Patent Number: 5,075,063

[45] Date of Patent: Dec. 24, 1991

[54] SPINNING CENTRIFUGE

[75] Inventor: Erich Lenk, Remscheid, Fed. Rep. of Germany

[73] Assignee: Barmag AG, Remscheid, Fed. Rep. of Germany

[21] Appl. No.: 125,132

[22] Filed: Nov. 25, 1987

[30] Foreign Application Priority Data

Nov. 29, 1986 [DE] Fed. Rep. of Germany ..... 3640962

[51] Int. Cl.[5] ..... B29C 47/00

[52] U.S. Cl. ..... 264/176.1; 425/72.2; 425/203; 425/382.2

[58] Field of Search ..... 264/8, 211.1, 176.1, 264/349; 425/8, 381.2, 382 N, 382.2, 203, 72.2; 65/6, 8, 15

[56] References Cited

U.S. PATENT DOCUMENTS

| | | | |
|---|---|---|---|
| 2,714,744 | 8/1955 | Becker | 264/349 |
| 3,488,416 | 1/1970 | Rothschild | 264/349 |
| 3,596,312 | 8/1971 | Ohmatsu | 264/165 |
| 3,633,494 | 1/1972 | Schippers et al. | 425/203 |
| 3,650,716 | 3/1972 | Brossard | 425/8 |
| 3,737,506 | 6/1973 | Martin et al. | 264/176.1 |
| 3,748,074 | 7/1973 | Nitta et al. | 264/176.1 |
| 3,776,669 | 12/1973 | Ito et al. | 425/8 |
| 3,800,985 | 4/1974 | Grout et al. | 425/204 |

FOREIGN PATENT DOCUMENTS

| | | | |
|---|---|---|---|
| 0168817 | 1/1986 | European Pat. Off. . | |
| 926682 | 4/1955 | Fed. Rep. of Germany . | |
| 1105554 | 4/1961 | Fed. Rep. of Germany . | |
| 2013997 | 10/1971 | Fed. Rep. of Germany . | |
| 38-4703 | 4/1963 | Japan | 264/8 |
| 40-18043 | 8/1965 | Japan | 425/382 N |
| 59-196208 | 11/1984 | Japan | 425/203 |

*Primary Examiner*—Jay H. Woo
*Assistant Examiner*—C. Scott Bushey
*Attorney, Agent, or Firm*—Bell, Seltzer, Park & Gibson

[57] ABSTRACT

A rotating spinning centrifuge is described for spinning yarns of a filament forming spinning material and which includes a centrifugal wheel and an elongate tubular central inlet sleeve fixed to the wheel. A pump is mounted in the inlet sleeve which serves to supply the spinning material under pressure and in a liquid state to the centrifugal wheel, and the pump is preferably designed and constructed as an extruder pump which includes an extruder screw and defining a rotating cylindrical jacket so that the spinning material is advanced under pressure to the centrifugal wheel.

17 Claims, 2 Drawing Sheets

SPINNING CENTRIFUGE

FIELD OF THE INVENTION

This invention relates generally to a rotating spinning centrifuge for spinning yarns of a filament forming spinning material, in particular polymers, such as polyesters, polyamides and polyolefins.

BACKGROUND OF THE INVENTION

European Patent Application No. 168 817, published Jan. 22, 1986, discloses a rotating spinning centrifuge in which the spinning material is pumped as a spinnable solution into the central inlet end of the spinning centrifuge by an extruder positioned outside of the spinning centrifuge. The extruder is provided to increase the spinning pressure applied to the spinning material above and beyond the pressure which can be obtained by centrifugal force with rotation of the spinning centrifuge. The disadvantage of this known spinning centrifuge resides in the fact that dynamic seals must be provided between the supply line and the rotating inlet central channel of the spinning centrifuge. These dynamic seals must not only withstand dynamic pressure loads, but also substantial increased temperatures which result in the seals not maintaining the proper sealing action over long periods of use. Sealing by means of pressurized gas volume is not practical because this would require a regulation of the fluid level in the sealing space containing the pressurized gas volume.

In contrast to the above, it is an object of the present invention to provide a spinning centrifuge in which the spinning solution is supplied under pressure without the use of dynamic seals.

SUMMARY OF THE INVENTION

The above and other objects and advantages of the present invention are achieved in the embodiments illustrated herein by the provision of a rotating spinning centrifuge which comprises a centrifugal wheel having an internal radial passage, and an elongate central inlet sleeve fixed to the wheel and defining a central axis and having an axial bore which communicates with the radial passage. A plurality of outlets are distributed about the periphery of the wheel and communicate with the radial passage, and with the outlets extending radially outwardly with respect to the central axis. The wheel and sleeve are mounted for rotation about the axis of the sleeve, and pump means is provided for supplying the spinning material under pressure through the bore of the inlet sleeve and in a liquid form to the internal passage of the centrifugal wheel. The pump means includes a first pump member which is mounted within the bore of the sleeve, and with the sleeve including a second pump member which cooperates with the first pump member upon rotation of the sleeve to advance the spinning material through the bore of the sleeve and to the centrifugal wheel. Also, drive means is provided for rotating the wheel and the sleeve about the central axis at a relatively high rotational speed, and which is sufficient to cause the liquid material to exit radially from the outlets.

In accordance with a preferred embodiment of the present invention, the first pump member comprises an extruder screw which is supported within the elongate tubular central inlet sleeve of the spinning centrifuge, and the rotating or second member of the pump is integrally formed with the inlet sleeve so that the pressure applied to the spinning solution is confined in the rotating spinning centrifuge. Because the present spinning centrifuge does not require dynamic seals, the pressure applied to the spinning solution in the spinning centrifuge can be very high.

Basically all pumps, which include the pairing of a rotating part and a stationary part, such as for example, the housing and gears of a gear pump, may be provided to convey and generate the pressure of a spinning solution. The usual pairing of the parts of a pump are reversed in accordance with a special feature of the present invention. For example, the normally stationary portion of the pump rotates in accordance with the present invention since it is formed integrally with the central inlet sleeve of the spinning centrifuge while the normally rotating portion of the pump is, in accordance with the present invention, maintained in a fixed position in the center portion of the central inlet sleeve. If the pump is constructed as an internal gear pump, the toothed rim may be mounted to the inlet sleeve of the centrifuge for rotation about a freely rotatable pinion meshing with said rim.

In accordance with the preferred embodiment of the present invention, the pump is in the form of an extruder. The advantage of the extruder resides in the fact that it includes a coaxial pairing of a screw and a cylinder so that it can be integrated in a mechanically simple construction into the elongate tubular central inlet sleeve of the spinning centrifuge. By providing the extruder pump in the elongate tubular central inlet sleeve, the requirement for compressive load seals is eliminated.

When the pump comprises an extruder in accordance with the present invention, the elongate tubular central inlet sleeve surrounds the extruder screw and defines a rotating cylindrical jacket. It is preferred that the spinning material be conveyed either in liquid form or in solid form of a powder or granules into the stationary extruder screw. The extruder screw may be provided with an axial feed passage with radial outlet channels which terminate in the spiral passage of the spinning centrifuge. The extruder jacket formed by the central inlet sleeve of the spinning centrifuge is slightly tapered in its entrance end portion so that it forms a funnel-shaped feed tube which expedites the feeding of the spinning material in solid, powdered, granular or liquid form.

A further advantage of the use of the extruder type pump is that it may serve not only to pump and thereby generate pressure, but also to melt the spinning material, for example, a filament-forming polymer. Accordingly, the metering device, by which the spinning material is advanced into the extruder, is constructed as a liquid pump or as a conveying means for powder or granules. In each instance, it is necessary that the spinning material be supplied in a measured quantity. When feeding the spinning material, the minimum quantity should correspond, even when the measured quantity fluctuates, to at least the quantity which would be spun in instances where the spinning pressure generated only by the centrifugal force is operative on the liquid spinning material in the spinning centrifuge.

The advantage of the invention with the use of the extruder pump is that the spinning centrifuge operates in a self-regulating manner when the aforesaid condition is maintained. That is, when the quantity of spun material is greater than the quantity of the spinning material advanced by the extruder, the pressure in the spinning centrifuge decreases and consequently the quantity of spun material also decreases. If the quantity of spun material is less than the quantity of the spinning material supplied to the extruder, a pressure builds up in the spinning centrifuge, resulting in an increase in the quantity of spun material. Thus, the metering device should be adjusted so that at least the quantity of the spinning material is supplied which is spun under the pressure generated by the centrifugal force. However, the maximum quantity of the spinning material supplied by the metering device should not be greater than the quantity of spun material, which is spun under the maximum possible pressure, i.e. the pressure generated by the extruder pump and the centrifugal force.

The spinning material may be supplied in the form of a powder or granules. In this instance, the extruder pump is preferably equipped so that the spinning material is melted in the extruder pump. The inner heat which is generated in the extruder pump due to the high speed of the rotating cylindrical jacket around the extruder screw should generally be sufficient to provide melting of the spinning material. If the amount of heat generated is not sufficient for melting, a contactless type of radiation or induction heater may be provided around the rotating cylindrical jacket of the extruder.

If the spinning material is to be supplied in liquid form, it may be supplied by means of a metering pump after the spinning material has been previously melted, for example, in an extruder. However, it is also possible to arrange a melting extruder or screw melter so that it precedes directly the extruder pump associated with the spinning centrifuge. Depending on the type of method practiced and the spinning materials used, there exists a risk of the formation of gas. Therefore, it is further suggested that degasification occurs in the elongate tubular central inlet sleeve of the extruder associated with the spinning centrifuge. To this end, a gas offtake line may be provided in the stationary screw of the extruder pump. If the extruder pump screw possesses a central inlet spiral passage through which the melt is advanced, the degassing or vacuum connection will be located parallel to the central inlet passage and terminate in the area of the spiral passage, in which the radial outlet channels of the central passage also terminate.

BRIEF DESCRIPTION OF THE DRAWINGS

Some of the objects and advantages of the present invention having been stated, others will appear as the description proceeds when taken in connection with the accompanying drawings, in which.

DESCRIPTION OF THE PREFERRED EMBODIMENTS

Figure 1:
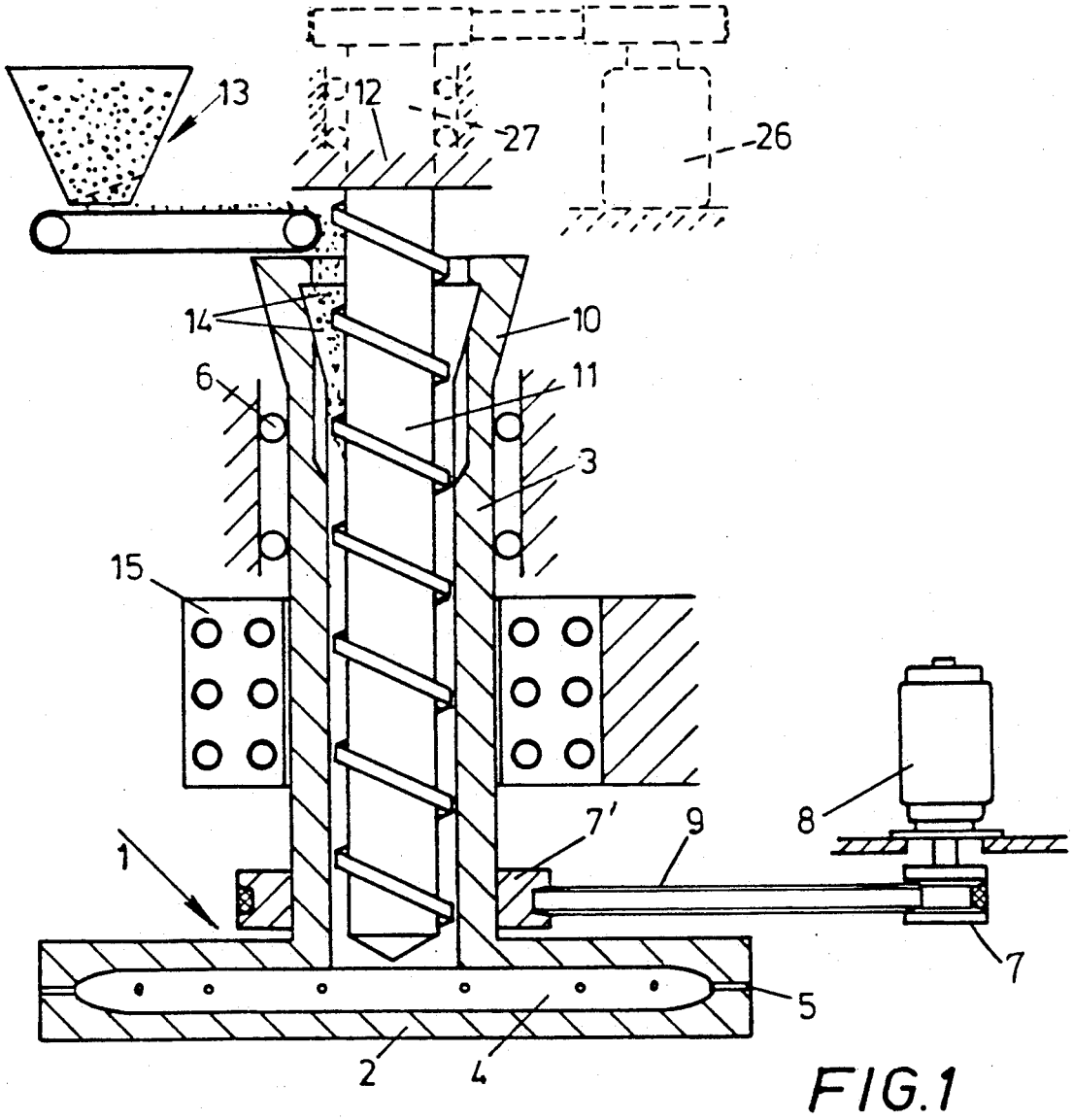
FIG. 1 is a schematic vertical sectional view of a first embodiment of the invention in which the spinning material is supplied in granular form.

A vertical sectional view of the spinning centrifuge, broadly indicated at 1, and forming the first embodiment of the present invention is shown in FIG. 1. The centrifuge 1 includes a centrifugal wheel 2 with an elongate tubular central inlet sleeve 3 integrally formed at the lower end with the centrifugal wheel 2 and extending upwardly therefrom. The centrifugal wheel 2 includes a disk-shaped radial passage 4, which may take the form of several radial channels. The radial passage 4 extends outwardly from the central inlet sleeve 3 and terminates in spinning openings or outlets 5 distributed around the periphery of the centrifugal wheel 2. An extruder screw 11 is mounted coaxially in the bore of the sleeve 3, and the sleeve 3 defines a rotating cylindrical extruder jacket supported for rotation in bearings 6. A motor 8 drives the sleeve 3 by means of a pair of drive pulleys 7, 7' and a drive belt 9.

The central inlet sleeve 3 is preferably rotated at a high rate of speed, for example, 500 rpm. A partial length of the sleeve 3 is heated by a heating jacket 15. The heating jacket 15 may be equipped with a plurality of electrical heating rods or tubes. Preferably, the heat is transferred in a contactless manner and by radiation with the heating jacket being maintained in a stationary position and forming a narrow gap surrounding the sleeve 3.

The upper free end of the inlet area of the sleeve 3 is tapered so that it forms a funnel tube filling end 10. The tapering conical upper filling end 10 tapers inwardly at a slight angle to reduce the risk that the inwardly fed granules would be flung outwardly by the centrifugal force. It is also preferred that the sleeve 3 be provided with axial grooves following the funnel tube filling end 10.

The extruder screw 11 is fixedly supported in a stationary and nonrotating position at its upper end in a fixed holder 12. In the illustrated embodiment, the lower end of the extruder screw 11 terminates in close proximity to the plane of the radial passage 4. Otherwise, the extruder screw 11 is of a normal construction and the particular design of which can be varied, depending on the type of spinning material to be spun and the other operating conditions, such as, in particular, the speed of the centrifugal wheel 2. Drive means may also be provided for imparting rotation to the extruder screw 11 at a speed and/or direction different from the rotational speed and direction of the rotating cylindrical jacket 3. For example, if the speed of rotation of the centrifugal wheel 2 results in undue shearing speeds and shearing forces in the spinning material, the extruder screw 11 may be rotatably supported and driven by an additional drive motor in the rotary direction of the sleeve 3 so that the relative speed is decreased between the extruder screw 11 and the sleeve 3. A drive motor 26 is illustrated in dotted lines for rotating the extruder screw 11. In this case, the upper end of the extruder screw 11 is supported in a suitable bearing 27, also illustrated in dotted lines.

The spinning material is supplied in the form of granules 14 by a metering device, broadly indicated at 13, which includes a feed hopper and a conveyor belt. The quantity of granules 14 supplied per unit of time should not exceed or fall below certain limiting values, which depend on the speed of the centrifugal wheel 2. The exceeding of the limiting value is harmless because this leads only to an overflow of the funnel tube 10. However, the quantity of the granules 14 supplied should not fall below the lower limiting value. The lower limiting value is the quantity of the spinnable material per unit of time which would be spun under the given operating conditions (in particular, temperature, viscosity, etc.) and under a pressure which is only generated by the centrifugal force generated at a particular speed. If the metered quantity of the spinning material falls below this limiting value, the spinning centrifuge 1 would run empty. Otherwise, a self-regulation occurs between the two limiting values because an equilibrium sets in between the quantity of spinnable material supplied, the pressure generated by the extruder and the pressure generated by centrifugal force, and the quantity of spun material produced.

Figure 2:
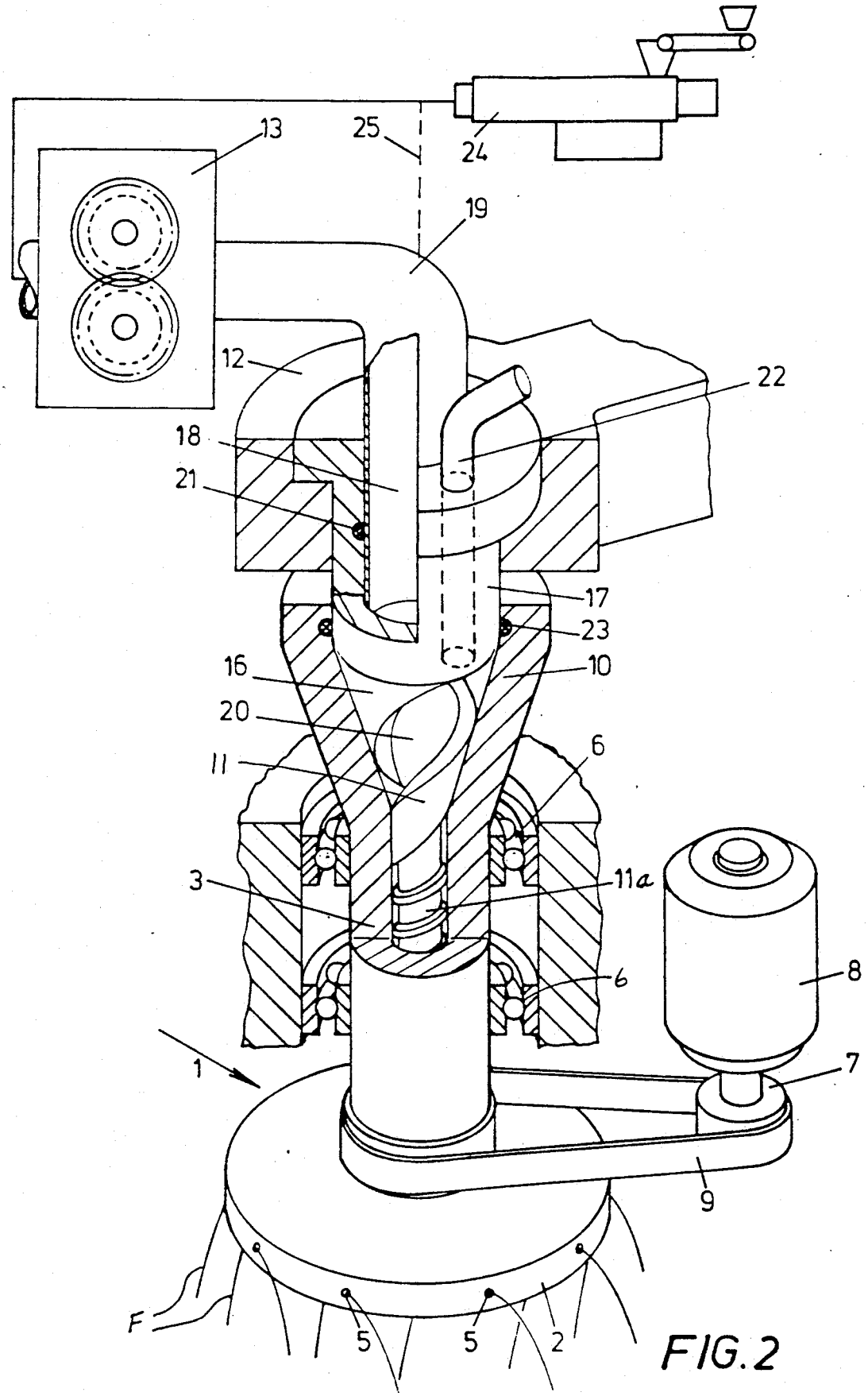
FIG. 2 is an elevational view, with parts in section, of a second embodiment of the present invention in which the spinning material is supplied in a molten or liquid condition.

The embodiment of the spinning centrifuge 1 of FIG. 2 also includes a centrifugal wheel 2 and an elongate tubular central inlet sleeve 3 defining a rotating cylindrical extruder jacket. The sleeve 3 is rotatably supported in bearings 6 and rotatingly driven by a drive motor 8, which acts through a drive transmission which includes the pulleys 7, 7' attached to the motor 8 and sleeve 3 respectively, and the belt 9. The spinning nozzle openings are indicated at 5 surrounding the centrifugal wheel 2. The exiting filaments F can be seen extending outwardly from the spinning nozzle openings 5. As in the embodiment of FIG. 1, radial channels can be arranged in the interior of the spinning wheel 2 to connect the central inlet sleeve 3 with the spinning openings 5.

In the embodiment of FIG. 2, the extruder screw 11 includes a lower cylindrical portion 11*a* which extends approximately into the spinning wheel 2. The extruder screw 11 also includes an outwardly tapered upper filling portion 16 and an upper cylindrical support portion 17. A central duct or feed passage 18 extends through the supporting portion 17 and the filling portion 16. The feed passage 18 terminates in a conical filling portion 10 of the sleeve 3 in radial outlets 20 which are illustrated as helicoidal recesses on the surface of the extruder screw 11. The helicoidal recesses 20 then terminate in the spiral passage or passages of the extruder screw 11. A feed tube 19 is connected at one end to a metering device, illustrated as a metering pump 13, and its other end terminates in the feed passage 18.

A closely measured quantity of spinning material is supplied to the extruder screw 11 by a metering gear pump 13 through the feed tube 19, the feed passage 18, and the helicoidal recesses 20. The metering pump 13 is fed by a metering and melting extruder 24, into which the spinning material is supplied as a powder or granules in a measured quantity. As indicated by the dash line 25, the spinning material which is melted by the extruder 24 may also be supplied directly into the feed tube 19 of the spinning centrifuge 1.

When the spinning material is melted, monomers or other ingredients may evaporate or be liberated as gases. For this reason, the supporting portion 17 of the extruder screw 11 is provided with a vacuum line connection 22 which serves as a gas takeoff line. The gas takeoff line extends parallel to the feed passage 18 and terminates in the helicoidal recess 20, from which the supplied fluid spinning substance exits from the central feed passage 18 radially outwardly into the spiral passage. A vacuum pump, not shown, may be connected to the gas takeoff line 22 to remove the gases as they are generated.

An upper seal is indicated at 21 to seal the feed tube 19 against the feed passage 18 of the extruder screw 11. It should be noted that this seal 21 must withstand only very slight pressures of the melt in the filling portion of the extruder. A lower seal 23 is also provided to seal the supporting portion 17 of the extruder screw 11 against the funnel tube 10 of the rotating sleeve 3. This seal 23 also needs to withstand only very slight pressures. Located below the seals 21 and 23 is the path of the melt in which the same is exposed to a vacuum or gas takeoff.

METHOD OF OPERATION

The metering devices 13 supply the filament-forming spinning material in the form of granules or powder (FIG. 1) or in molten or liquid form (FIG. 2) to the spinning centrifuge 1. Such spinning material may be, for example, polypropylene, polyamides, or polyester. The spinning material advances into the sleeve 3 which rotates at a high speed. In the embodiment of FIG. 2, a degasification occurs in the inlet portion of the sleeve 3 by means of the vacuum line 22. As a result of the relative movement between the stationary (or slowly rotating) extruder screw 11 and the rotating sleeve 3, the spinning material is melted in the embodiment of FIG. 1, and otherwise is advanced under a high pressure into the interior of the centrifugal spinning wheel 2. The melted spinning material is deflected radially outwardly and through the nozzle openings 5 to form extruded filaments thereof. In the centrifugal spinning wheel 2 the spinning material is under a high pressure which is generated by the extruder pump on the one hand, and by the centrifugal force on the other hand.

The use of an extruder pump or other pumping mechanism, which is positioned in the elongate tubular central inlet sleeve 3 of the spinning centrifuge 1, has the advantage that such an extruder pump does not require any dynamic seal which is under a high pressure. Consequently, the extruder pump can generate pressures which correspond to the pressures which are normal in the spinning operation. Added to this pressure is the pressure which is generated by the centrifugal force of the rotating spinning wheel 2. As a result, it is possible to also spin highly viscous melts to produce fine deniers and without having to increase the delivery speed of the filament to an undue extent. In particular, spinning nozzle openings 5 with very small cross sections may be used. On the other hand, the speed of the centrifuge spinning wheel 2 may be adjusted and optimized irrespective of the pressure required for the spinning operation.

In the drawings and specification there has been set forth the best modes presently contemplated for the practice of the present invention, and although specific terms are employed, they are used in a generic and descriptive sense only and not for purposes of limitation, the scope of the invention being defined in the claims.

That which is claimed is:

1. A rotating spinning centrifuge for spinning yarns of a filament forming spinning material, in particular polymers, such as polyesters, polyamides and polyolefins, said spinning centrifuge comprising;

a centrifugal wheel having an internal radial passage, an elongate central inlet sleeve defining a central axis and being fixed to said centrifugal wheel and having an axial bore which communicates with said radial passage, a plurality of outlets distributed about the periphery of said wheel and communicating with said radial passage, and with said outlets extending radially outwardly with respect to said central axis, and means mounting said wheel and said sleeve for rotation about said central axis of said sleeve, and pump means for supplying the spinning material under pressure through said bore of said inlet sleeve and in a liquid state to said internal radial passage of said centrifugal wheel, said pump means including a first pump member, means mounting said first pump member within said bore of said sleeve, and with said sleeve defining a second pump member which cooperates with said first pump member upon rotation of said sleeve to advance the spinning material through said bore of said sleeve, and drive means for rotating said wheel and said sleeve about said central axis at a relatively high rotational speed and which is sufficient to cause the liquid material to exit radially from said outlets.

2. A rotating spinning centrifuge according to claim 1 further comprising a metering device preceding said pump means and being operable to supply a measured quantity of the spinning material in liquid form to said pump means.

3. A rotating spinning centrifuge according to claim 2 further comprising a stationary heating sleeve surrounding said sleeve and being operable to transfer heat energy in a contactless manner by radiation or induction to said sleeve.

4. A rotating spinning centrifuge according to claim 3 further comprising a melting extruder preceding said metering device.

5. A rotating spinning centrifuge according to claim 4 further comprising a vacuum line connected for degassing the liquid spinning material while in said bore of said sleeve.

6. A rotating spinning centrifuge for spinning yarns of a filament forming spinning material, in particular polymers, such as polyesters, polyamides and polyolefins, said spinning centrifuge comprising;

a centrifugal wheel having an internal radial passage, an elongate central inlet sleeve defining a central axis and being fixed to said centrifugal wheel and having an axial bore which communicates with said radial passage, a plurality of outlets distributed about the periphery of said wheel and communicating with said radial passage, and with said outlets extending radially outwardly with respect to said central axis, and means mounting said wheel and said sleeve for rotation about said central axis of said sleeve, and pump means for supplying the spinning material under pressure through said bore of said inlet sleeve and in a liquid state to said internal radial passage of said centrifugal wheel, said pump means including an extruder screw, means mounting said extruder screw within said bore of said sleeve, and with said sleeve defining a rotatable cylindrical jacket surrounding said extruder screw which cooperates with said extruder screw upon rotation of said sleeve to advance the spinning material through said bore of said sleeve, and drive means for rotating said wheel and said sleeve about said central axis at a relatively high rotational speed and which is sufficient to cause the liquid material to exit radially from said outlets.

7. A rotating spinning centrifuge according to claim 6 wherein said extruder screw includes a central inlet bore with radial outlet channels and wherein said outlet channels terminate in a spiral passage.

8. A rotating spinning centrifuge according to claim 7 further comprising means for drawing a partial vacuum in the area of said central inlet bore.

9. A rotating spinning centrifuge according to claim 6 wherein said extruder screw is fixedly mounted so as to preclude rotation thereof.

10. A rotating spinning centrifuge according to claim 6 wherein said drive means imparts rotation to aid extruder screw at a speed different from the rotational speed of said rotating cylindrical jacket.

11. A rotating spinning centrifuge according to claim 6 further comprising means for melting the spinning material and supplying a metered quantity of the melted spinning material to said bore of said inlet sleeve and said pump means.

12. The rotating spinning centrifuge according to claim 6, wherein said drive means is constructed so as to rotate said wheel and sleeve at a rotational speed of about 500 rpm.

13. The rotating spinning centrifuge according to claim 6 wherein said drive means imparts rotation to said extruder screw in a rotational direction opposite that of said rotating cylindrical jacket.

14. The rotating spinning centrifuge according to claim 13 wherein said drive imparts rotation to said extruder screw at a speed different from the rotational speed of said rotating cylindrical jacket.

15. A method of spinning yarns from a filament forming spinning material, in particular polymers, such as polyesters, polyamides and polyolefins, and comprising the steps of;

providing a centrifugal wheel having an internal radial passage, an elongate central inlet sleeve defining a central axis and being fixed to said centrifugal wheel and having an axial bore which communicates with said radial passage, a plurality of outlets distributed about the periphery of said wheel and communicating with said radial passage, and with said outlets extending radially outwardly with respect to said central axis, and means mounting said wheel and said sleeve for rotation about said central axis of said sleeve, providing a first pump member within said bore of said sleeve, and with said sleeve defining a second pump member which cooperates with said first pump member upon rotation of said sleeve to advance the spinning material through said bore of said sleeve, supplying the spinning material to said bore of said inlet sleeve, and while rotating said wheel and said sleeve about said central axis and at a relatively high rotational speed with respect to said first pump member and while causing said material to be heated and in a liquid state upon entering said internal radial passage and so that the resulting liquid material exits radially from said outlets.

16. A method of spinning yarns from a filament forming spinning material, in particular polymers, such as polyesters, polyamides and polyolefins, and comprising the steps of;

providing a centrifugal wheel having an internal radial passage, an elongate central inlet sleeve defining a central axis and being fixed to said centrifugal wheel and having an axial bore which communicates with said radial passage, a plurality of outlets distributed about the periphery of said wheel and communicating with said radial passage, and with said outlets extending radially outwardly with respect to said central axis, and means mounting said wheel and said sleeve for rotation about said central axis of said sleeve, providing an extruder screw within said bore of said sleeve, and such that said sleeve defines a rotatable cylindrical jacket surrounding said extruder screw which is rotatable with respect to said extruder screw, and which cooperates with said extruder screw upon rotation of said sleeve to advance the spinning material through said bore of said sleeve, supplying the spinning material to said bore of said inlet sleeve, and while rotating said wheel and said sleeve about said central axis and at a relatively high rotational speed with respect to said extruder screw and while causing said material to be heated and in a liquid state upon entering said internal radial passage and so that the resulting liquid material exits radially from said outlets.

17. The method as defined in claim 16 wherein the step of rotating said wheel and said sleeve comprises rotating the same at a rotational speed of about 500 rpm.

* * * * *